US011771615B2

(12) United States Patent
Diao et al.

(10) Patent No.: US 11,771,615 B2
(45) Date of Patent: Oct. 3, 2023

(54) METHOD OF STEERING ASSIST CONTROL FOR WALKER, DEVICE OF STEERING ASSIST CONTROL AND MEMORY

(71) Applicant: ZHEJIANG YIHENGYUE MEDICAL TECHNOLOGY CO., LTD, Taizhou (CN)

(72) Inventors: Jian Diao, Shenzhen (CN); Mao Gong, Liupanshui (CN)

(73) Assignee: ZHEJIANG YIHENGYUE MEDICAL TECHNOLOGY CO., LTD, Taizhou (CN)

( * ) Notice: Subject to any disclaimer, the term of this patent is extended or adjusted under 35 U.S.C. 154(b) by 0 days.

(21) Appl. No.: 17/964,012

(22) Filed: Oct. 11, 2022

(65) Prior Publication Data

US 2023/0233399 A1 Jul. 27, 2023

Related U.S. Application Data

(63) Continuation of application No. PCT/CN2022/074108, filed on Jan. 26, 2022.

(51) Int. Cl.
*A61H 3/04* (2006.01)

(52) U.S. Cl.
CPC ..... *A61H 3/04* (2013.01); *A61H 2003/043* (2013.01)

(58) Field of Classification Search
CPC ..... A61H 3/04; A61H 2003/043
See application file for complete search history.

(56) References Cited

U.S. PATENT DOCUMENTS

| | | | | |
|---|---|---|---|---|
| 9,186,992 | B2 * | 11/2015 | Katayama | B60K 28/16 |
| 9,227,647 | B2 * | 1/2016 | Masaki | B62B 5/0069 |
| 9,968,507 | B2 * | 5/2018 | Rabin | B60L 15/2036 |
| 10,188,579 | B2 * | 1/2019 | Song | A61B 5/6887 |
| 10,667,980 | B2 * | 6/2020 | Shen | G05D 1/0246 |
| 11,432,978 | B1 * | 9/2022 | Inkmann | A61H 3/04 |
| 2015/0066278 | A1 * | 3/2015 | Katayama | A61H 3/04 180/6.66 |

(Continued)

FOREIGN PATENT DOCUMENTS

| | | | |
|---|---|---|---|
| CN | 102201765 | A | 9/2011 |
| CN | 107187337 | A | 9/2017 |

(Continued)

*Primary Examiner* — Kevin Hurley
*Assistant Examiner* — Maurice L Williams

(57) ABSTRACT

The present disclosure discloses a method, a device of steering assist control for a walker, and a memory. The method includes acquiring a first moving speed of the left wheel and a second moving speed of the right wheel; determining whether the left wheel and/or the right wheel is in a steering state; calculating a steering angle estimate or a speed difference between the first moving speed and the second moving speed when in the steering state; acquiring steering assist compensations; and performing an assist compensation on the left wheel and/or the right wheel. The method can make the user more effortless when pushing the walker to turn, making it more convenient for users with less strength to use the walker, and reducing impact of the steering on the travel speed. Sudden stop caused by the increase of steering resistance can be avoided, and safety can be improved.

19 Claims, 10 Drawing Sheets

(56) References Cited

U.S. PATENT DOCUMENTS

| | | | | |
|---|---|---|---|---|
| 2015/0066325 | A1* | 3/2015 | Tanaka | A61H 3/04 701/70 |
| 2017/0129523 | A1* | 5/2017 | Hane | B62B 5/0033 |
| 2018/0271739 | A1* | 9/2018 | Watabe | A61H 3/04 |
| 2019/0358821 | A1* | 11/2019 | Yamada | B25J 5/007 |
| 2020/0253798 | A1* | 8/2020 | Mizuno | A61G 5/048 |
| 2022/0096311 | A1* | 3/2022 | Syue | A61H 3/00 |
| 2022/0183920 | A1* | 6/2022 | Raja | A61G 5/04 |
| 2022/0218555 | A1* | 7/2022 | Raja | B60L 15/2018 |
| 2022/0382282 | A1* | 12/2022 | Guo | G06V 40/103 |

FOREIGN PATENT DOCUMENTS

| | | | |
|---|---|---|---|
| CN | 111361496 | A | 7/2020 |
| CN | 113552822 | A | 10/2021 |
| JP | 2006230421 | A | 9/2006 |
| JP | 2019072183 | A | 5/2019 |

* cited by examiner

METHOD OF STEERING ASSIST CONTROL FOR WALKER, DEVICE OF STEERING ASSIST CONTROL AND MEMORY

TECHNICAL FIELD

The present disclosure relates to the technical field of medical devices, and in particular, to a method, a device and a memory of steering assist control for walker.

BACKGROUND

A walker can make the elderly, patients with inconvenient legs, and even people who have lost the ability to walk can go out and walk like normal people through supporting them by the device. The user inevitably needs to perform operations such as steering during the walking process.

At present, the steering of the walker is completely realized by the user's force, and the resistance during steering will be greater than that of pushing toward the straight line. The users of the walker are generally a special group of people with less strength, so when the steering resistance increases, it will cause inconvenience and affect the user's travel.

SUMMARY

The present disclosure provides a method of steering assist control, a device of steering assist control and a memory for a walker, so as to solve the technical problem of inconvenience caused by increased resistance when a user uses the walker to turn.

In order to solve the above technical problems, a technical solution adopted by the present disclosure is to provide a method of steering assist control for a walker, wherein the walker includes a main frame and a left wheel and a right wheel respectively provided at the bottom of the main frame, the method of steering assist control includes:

acquiring a first moving speed of the left wheel and a second moving speed of the right wheel;

determining whether the left wheel and/or the right wheel is in a steering state;

calculating a steering angle estimate or a speed difference between the first moving speed and the second moving speed according to the first moving speed and the second moving speed when the left wheel and/or the right wheel is in the steering state; and acquiring steering assist compensations according to the steering angle estimate or the speed difference, and performing an assist compensation on the left wheel and/or the right wheel according to the steering assist compensations.

According to one embodiment of the invention, wherein the step of determining whether the left wheel and/or the right wheel is in a steering state comprises:

acquiring a first moving direction of the left wheel and a second moving direction of the right wheel;

determining whether both the first moving direction and the second moving direction are forward or backward, and whether the difference between the first moving speed and the second moving speed is less than a threshold;

determining that the left wheel and/or the right wheel is in a straight state when both the first moving direction and the second moving direction are forward or backward, and the difference between the first moving speed and the second moving speed is less than the threshold;

determining that the left wheel and/or the right wheel is in the steering state when otherwise.

According to one embodiment of the invention, wherein after determining that the left wheel and/or the right wheel is in a steering state, the method further comprises:

determining a steering operation state of the walker according to the first moving speed, the first moving direction, the second moving speed and the second moving direction.

According to one embodiment of the invention, wherein the step of determining a steering operation state of the walker according to the first moving speed, the first moving direction, the second moving speed and the second moving direction comprises:

determining that the walker is turned forward left when the second moving direction is forward, and an absolute of the second moving speed is greater than or equal to an absolute of the first moving speed;

determining that the walker is turned forward right when the first moving direction is forward, and the absolute of the first moving speed is greater than or equal to the absolute of the second moving speed;

determining that the walker is turned backward left when the first moving direction is backward, and the absolute of the first moving speed is greater than the absolute of the second moving speed;

determining that the walker is turned backward right when the second moving direction is backward, and the absolute of the second moving speed is greater than the absolute of the first moving speed.

According to one embodiment of the invention, wherein the step of calculating the steering angle estimate comprises:

calculating the steering angle estimate $\alpha=-45°\pm V1/V2*45°$ when the walker is turned forward left, where V1 is the first moving speed, and V2 is the second moving speed;

calculating the steering angle estimate $\alpha=45°-V2/V1*45°$ when the walker is turned forward right;

calculating the steering angle estimate $\alpha=-45°-V2/V1*45°$ when the walker is turned backward left;

calculating the steering angle estimate $\alpha=45°-V1/V2*45°$ when the walker is turned backward right.

According to one embodiment of the invention, wherein the assist compensations comprise a first assist compensation and/or a second assist compensation, and the step of calculating the steering assist compensations according to the steering angle estimate comprises:

calculating the first assist compensation according to the steering angle estimate and the first moving speed; and/or calculating the second assist compensation according to the steering angle estimate and the second moving speed.

According to one embodiment of the invention, wherein the assist compensations comprise a first assist compensation and/or a second assist compensation;

if the walker is turned forward left or tuned backward right, the first assist compensation is inversely proportional to the first moving speed and the steering angle estimate, and the second assist compensation is proportional to the second moving speed and the steering angle estimate;

if the walker is turned forward right or tuned backward left, the first assist compensation is proportional to the first moving speed and the steering angle estimate, and the second assist compensation is inversely proportional to the second moving speed and the steering angle estimate.

According to one embodiment of the invention, wherein the assist compensations comprise a first assist compensation and/or a second assist compensation;

the first assist compensation $P1=K*(|\alpha|*V1/M1)*(|\alpha|/90+1))$, where K is a proportional parameter in different gears, is an absolute of the steering angle estimate, V1 is the first moving speed, and M1 is an adjustment ratio of the left wheel speed;

the second assist compensation $P2=K*(|\alpha|*V2/M2)*(|\alpha|/90+1)$, where V2 is the second moving speed, and M2 is an adjustment ratio of the right wheel speed.

According to one embodiment of the invention, wherein the walker further comprises a driver configured for driving the left wheel and/or the right wheel, the step of performing an assist compensation on the left wheel and/or the right wheel according to the steering assist compensations comprises:

taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

According to one embodiment of the invention, wherein K is 0.1 to 1, M1 is 1 to 100, and M2 is 1 to 100.

According to one embodiment of the invention, wherein the threshold value is less than or equal to 5 rad/min.

According to one embodiment of the invention, wherein before acquiring the first moving speed of the left wheel and the second moving speed of the right wheel, the method further comprises:

determining whether steering assist compensation is required for the left wheel and/or the right wheel;

acquiring the first moving speed of the left wheel and the second moving speed of the right wheel when steering assist compensation is required for the left wheel and/or the right wheel;

performing no operation when otherwise.

According to one embodiment of the invention, wherein the step of determining whether steering assist compensation is required for the left wheel and/or the right wheel comprises:

determining whether a load of the main frame exceeds a weight threshold;

performing the steering assist compensation on the left wheel and/or the right wheel when the load of the main frame exceeds the weight threshold;

performing no operation when otherwise.

According to one embodiment of the invention, wherein the step of determining whether steering assist compensation is required for the left wheel and/or the right wheel comprises:

determining whether a friction between the left and/or right wheels and a road surface exceeds a resistance threshold;

performing the steering assist compensation on the left wheel and/or the right wheel when the friction between the left and/or right wheels and the road surface exceeds the resistance threshold;

performing no operation when otherwise.

According to one embodiment of the invention, wherein the assist compensations comprise a first assist compensation and/or a second assist compensation;

if the walker is turned forward left or is turned backward right, the first assist compensation is inversely proportional to the first moving speed and the speed difference, and the second assist compensation is proportional to the second moving speed and the speed difference;

if the walker is turned forward right or is turned backward left, the first assist compensation is proportional to the first moving speed and the speed difference, and the second assist compensation is inversely proportional to the second moving speed and the speed difference.

According to one embodiment of the invention, wherein the assist compensations comprise a first assist compensation and/or a second assist compensation, and the step of acquiring steering assist compensations according to the speed difference comprises:

taking that the first assist compensation P1=K*DV*N1, and that the second assist compensation P2=K*DV*N2, where K is the proportional parameter in different gears, DV is the speed difference, N1 is a differential compensation ratio of the left wheel, and N2 is a differential compensation ratio of the right wheel.

According to one embodiment of the invention, wherein the walker further comprises a driver configured for driving the left wheel and/or the right wheel, and the step of performing the steering assist compensation on the left wheel and/or the right wheel according to the steering assist compensations comprises:

taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

According to one embodiment of the invention, wherein K is 0.1 to 1, N1 is 0 to 1, and N2 is 0 to 1.

In order to solve the above technical problems, another technical solution adopted by the present disclosure is to provide a device of steering assist control for a walker, the walker includes a main frame and a left wheel and a right wheel respectively provided at the bottom of the main frame; the device of steering assist control includes:

a processor configured for acquiring a first moving speed of the left wheel and a second moving speed of the right wheel, determining whether the left wheel and/or the right wheel is in a steering state, calculating a steering angle estimate or a speed difference between the first moving speed and the second moving speed according to the first moving speed and the second moving speed when the left wheel and/or the right wheel is in the steering state, and acquiring steering assist compensations according to the steering angle estimate or the speed difference; and a controller configured for performing an assist compensation on the left wheel and/or the right wheel according to the steering assist compensations.

In order to solve the above technical problem, yet another technical solution adopted by the present disclosure is to provide a memory storing program data which can be executed to implement the above-mentioned method of steering assist control.

The method of steering assist control for the walker of the present disclosure includes acquiring a first moving speed of the left wheel and a second moving speed of the right wheel;

determining whether the left wheel and/or the right wheel is in a steering state; calculating a steering angle estimate or a speed difference between the first moving speed and the second moving speed according to the first moving speed and the second moving speed when in the steering state; acquiring steering assist compensations according to the steering angle estimate or the speed difference; and performing an assist compensation on the left wheel and/or the right wheel according to the steering assist compensations. By compensating the left wheel and/or the right wheel of the walker when the walker turns, it can make the user save more effort when pushing the walker to turn, such that the user can save more effort when pushing the walker to turn, making it more convenient for users with less strength to use the walker, reducing the influence of the steering on the speed of the walker. The normal travel of the walker can be ensured, sudden standstill due to increased steering resistance can be avoided, and the safety can be improved.

BRIEF DESCRIPTION OF DRAWINGS

In order to illustrate the technical solutions in the embodiments of the present disclosure more clearly, the following briefly introduces the accompanying drawings used in the description of the embodiments. Obviously, the accompanying drawings in the following description are only some embodiments of the present disclosure. For those of ordinary skill in the art, under the premise without inventive work, other drawings can also be obtained from these drawings, wherein.

DESCRIPTION OF EMBODIMENTS

The technical solutions in the embodiments according to the present disclosure will be clearly and completely described below with reference to the accompanying drawings in the embodiments according to the present disclosure. Obviously, the described embodiments are only a part of the embodiments of the present disclosure, but not all of the embodiments. Based on the embodiments of the present disclosure, all other embodiments obtained by those of ordinary skill in the art without inventive efforts shall fall within the protection scope of the present disclosure.

The terms "first" and "second" in this application are only used for descriptive purposes, and should not be construed as indicating or implying relative importance or implicitly indicating the number of indicated technical features. In the description of the present application, "a plurality of" means at least two, such as two, three, etc., unless otherwise expressly and specifically defined. Furthermore, the terms "comprising" and "having" and any variations thereof are intended to cover non-exclusive inclusion. For example, a process, method, system, product or device comprising a series of steps or units is not limited to the listed steps or units, but optionally also includes unlisted steps or units, or optionally also includes for other steps or units inherent to these processes, methods, products or devices. The term "and/or" is only an association relationship to describe the associated objects, which means that there can be three kinds of relationships, for example, A and/or B, which can mean that A exists alone, A and B exist at the same time, and B exists alone these three situations. In addition, the character "/" in this document generally indicates that the related objects are an "or" relationship.

Figure 1:
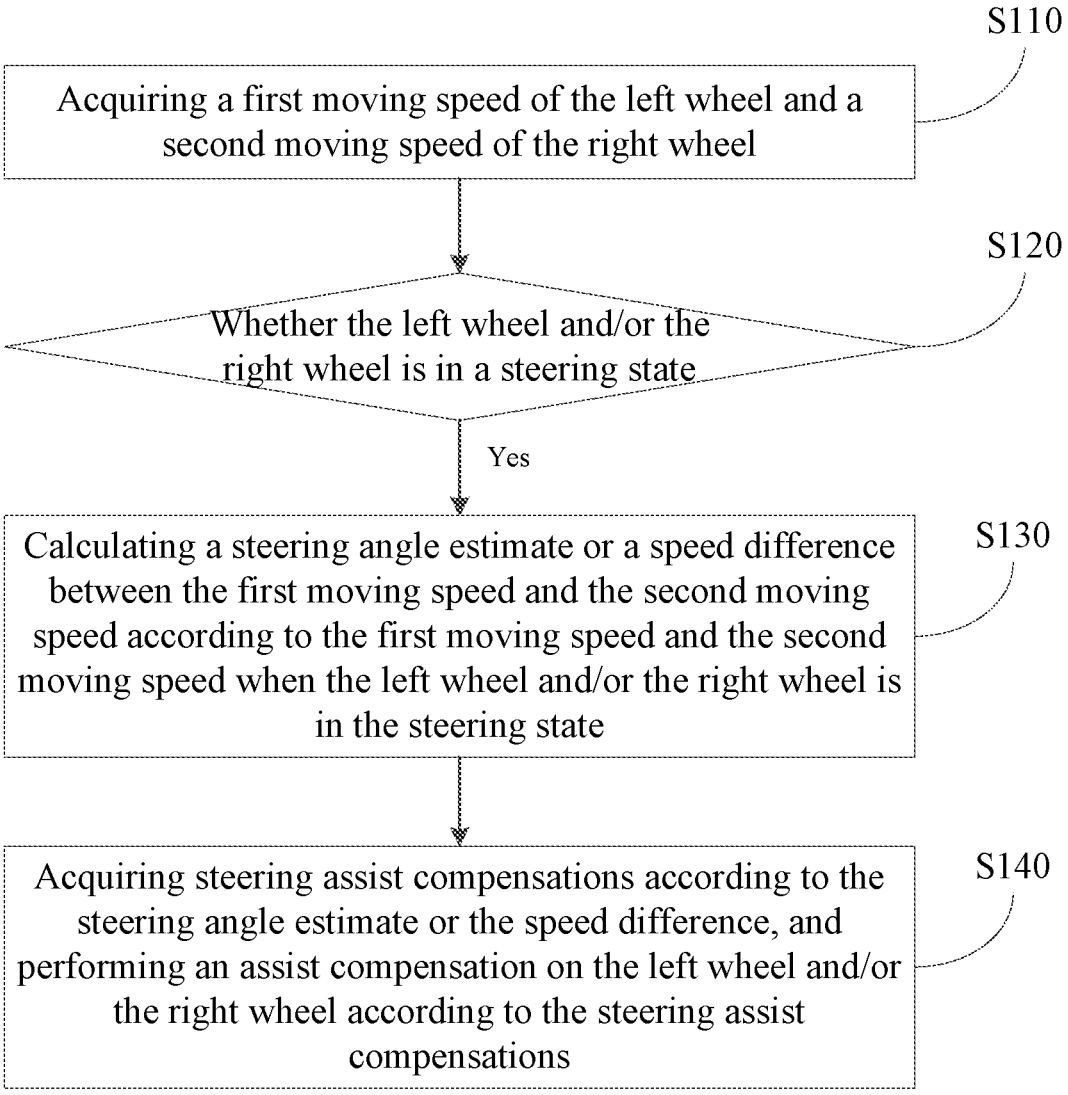
FIG. 1 is a schematic flowchart illustrating a method illustrating steering assist control for a walker according to an embodiment of the present disclosure.

Referring to FIG. 1, the walker according to the present disclosure may include a main frame, a left wheel and a right wheel respectively provided at the bottom of the main frame. An embodiment of a method of steering assist control for the walker may include:

S110, acquiring a first moving speed of the left wheel and a second moving speed of the right wheel;

In the embodiment, the first moving speed of the left wheel and the second moving speed of the right wheel can be acquired through the number of turns and the rotational speed of the left wheel and/or the right wheel per unit time.

S120, determining whether the left wheel and/or the right wheel is in a steering state;

In the embodiment, whether the left wheel and/or the right wheel is in a steering (or turning) state can be determined according to the first moving speed and/or the second moving speed.

In other embodiments, whether the left wheel and/or the right wheel is in a turning state can also be determined by the driving force and driving direction of the driver for driving the left wheel and/or the right wheel. Whether the left wheel and/or the right wheel is in a turning state can also be determined by means of image detection of the left wheel and/or the right wheel, which is not limited herein.

S130, calculating a steering angle estimate or a speed difference between the first moving speed and the second moving speed according to the first moving speed and the second moving speed when the left wheel and/or the right wheel is in the steering state;

S140, acquiring steering assist compensations according to the steering angle estimate or the speed difference, and performing an assist compensation on the left wheel and/or the right wheel according to the steering assist compensations.

In the embodiment, the left wheel and/or the right wheel of the walker can be performed with assist compensation when the walker is turned, such that the user can save more effort when pushing the walker to turn, such that the user with less strength can use the walker. It is more convenient to use when driving, reduces the influence of steering on the traveling speed of the walker. The normal travel of the walker can be ensured, sudden stop caused by the increase of steering resistance can be avoided, and safety can be improved.

In other embodiments, before acquiring the first moving speed of the left wheel and the second moving speed of the right wheel, the method may further include:

determining whether steering assist compensation is required for the left wheel and/or the right wheel;

acquiring the first moving speed of the left wheel and the second moving speed of the right wheel when steering assist compensation is required for the left wheel and/or the right wheel;

performing no operation when otherwise.

Wherein, whether it is necessary to perform steering assist compensation for the left wheel and/or the right wheel may be determined according to the load of the main frame and/or the road surface conditions. For example, the load of the main frame is acquired, and it is determined whether the load of the main frame exceeds the weight threshold (such as 20 kg, 25 kg, etc.). When the load of the main frame exceeds the weight threshold, it is determined that it is necessary to perform steering assist compensation for the left wheel and/or the right wheel; otherwise, no steering assist compensation is required for the left and/or right wheels. For another example, the friction force between the left wheel and/or the right wheel and the road surface is acquired, and it is determined whether the friction exceeds a resistance threshold. If the friction force between the left wheel and/or the right wheel and the road surface exceeds the resistance threshold, it is determined that the steering assist compensation for the left wheel and/or the right wheel needs to be performed, otherwise it is not necessary to perform the steering assist compensation for the left wheel and/or the right wheel. For yet another example, it is determined whether the walker is in an uphill state and the slope angle is greater than or equal to the angle threshold. If the walker is in an uphill state and the slope angle is greater than or equal to the angle threshold, it is determined that the steering assist compensation is required to be performed on the left wheel and/or the right wheel, otherwise it is not necessary to perform steering assist compensation on the left and/or right wheels.

Figure 2:
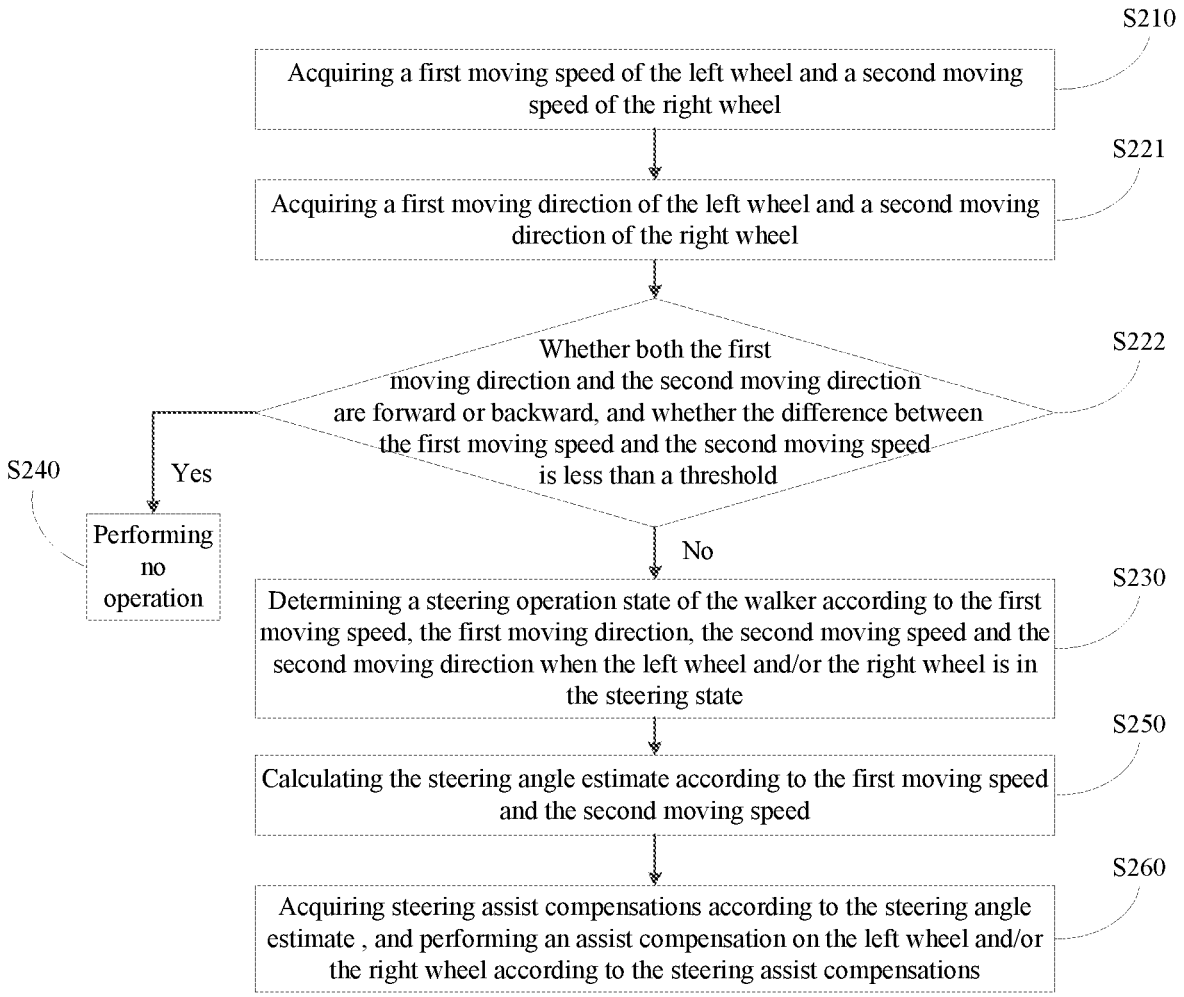
FIG. 2 is a schematic flowchart illustrating the method of steering assist control for a walker according to another embodiment of the present disclosure.

Referring to FIG. 2, the walker of the present disclosure may include a main frame, a left wheel and a right wheel respectively provided at the bottom of the main frame. Another embodiment of the method of steering assist control of the walker may include:

S210, acquiring a first moving speed of the left wheel and a second moving speed of the right wheel;

In the embodiment, for the step of acquiring the first moving speed and the second moving speed, reference may be made to the above embodiment of the step of method of steering assist control for a walker, and details are not described herein again.

S220, determining whether the left wheel and/or the right wheel is in a steering state;

In the embodiment, the step for determining whether the left wheel and/or the right wheel is in a steering state may specifically include:

S221, acquiring a first moving direction of the left wheel and a second moving direction of the right wheel;

In the embodiment, the moving directions of the left and right wheels may be divided into two directions: front and back, and the moving directions of the left and right wheels can be determined by detecting the rotation directions of the left and right wheels. For example, in the left-view state, if the rotation directions of the left wheel and the right wheel are clockwise, then the left wheel and the right wheel are moving in the backward direction; if the rotation directions of the left wheel and the right wheel are counterclockwise, then the left wheel and the right wheel are moving in the forward direction.

S222, determining whether both the first moving direction and the second moving direction are forward or backward, and whether the difference between the first moving speed and the second moving speed is less than a threshold;

determining that the left wheel and/or the right wheel is in a straight state when both the first moving direction and the second moving direction are forward or backward, and the difference between the first moving speed and the second moving speed is less than the threshold;

determining that the left wheel and/or the right wheel is in the steering state when otherwise.

Due to road conditions, the accuracy of the walker itself, etc., the first moving speed and the second moving speed cannot always be consistent during the straight process of the walker. By setting a threshold, it can be determined that the walker is in the straight state when the difference between the first moving speed and the second moving speed falls within the error range, such that the probability of misjudgment can be reduced.

In the embodiment, the threshold may be less than or equal to 5 rad/min, for example, 2 rad/min, 3 rad/min, or 5 rad/min.

S230, determining a steering operation state of the walker according to the first moving speed, the first moving direction, the second moving speed and the second moving direction when the left wheel and/or the right wheel is in the steering state.

Figure 3:
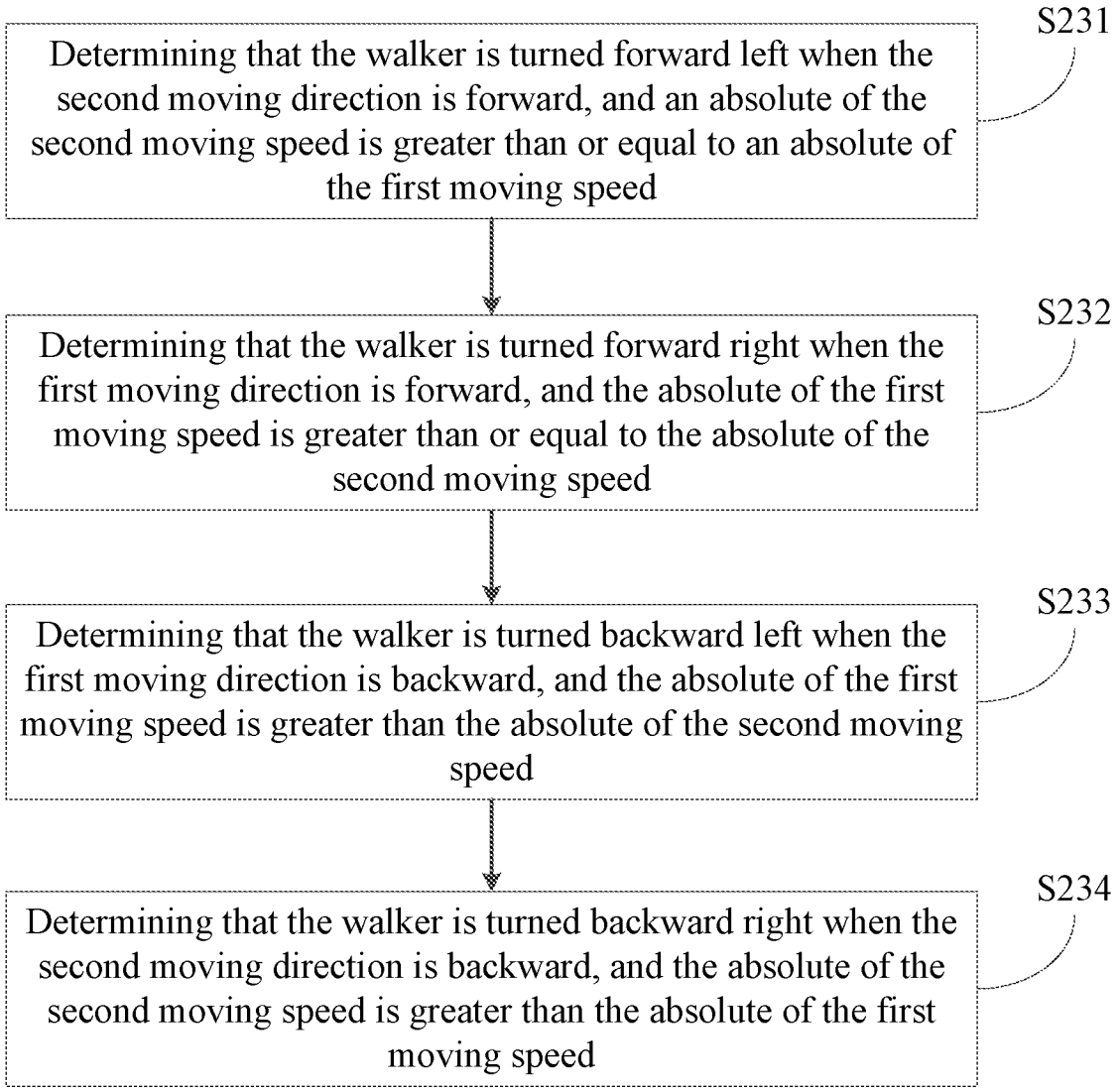
FIG. 3 is a schematic flowchart illustrating some steps of the method of steering assist control for a walker according to another embodiment of the present disclosure.

Referring to FIG. 3, in the embodiment, the step of determining a steering operation state of the walker may specifically include:

S231, determining that the walker is turned forward left when the second moving direction is forward, and an absolute of the second moving speed is greater than or equal to an absolute of the first moving speed;

S232, determining that the walker is turned forward right when the first moving direction is forward, and the absolute of the first moving speed is greater than or equal to the absolute of the second moving speed;

S233, determining that the walker is turned backward left when the first moving direction is backward, and the absolute of the first moving speed is greater than the absolute of the second moving speed;

S234, determining that the walker is turned backward right when the second moving direction is backward, and the absolute of the second moving speed is greater than the absolute of the first moving speed.

The running status of the walker may be divided into straight, forward left, forward right, backward left, and backward right. Through the distinction of the status, the subsequent steering angle estimate and steering assist compensation can be obtained more precise.

Referring back to FIG. 2, S240, performing no operation when the left wheel and/or the right wheel are not in the steering state.

S250, calculating the steering angle estimate according to the first moving speed and the second moving speed.

Figure 4:
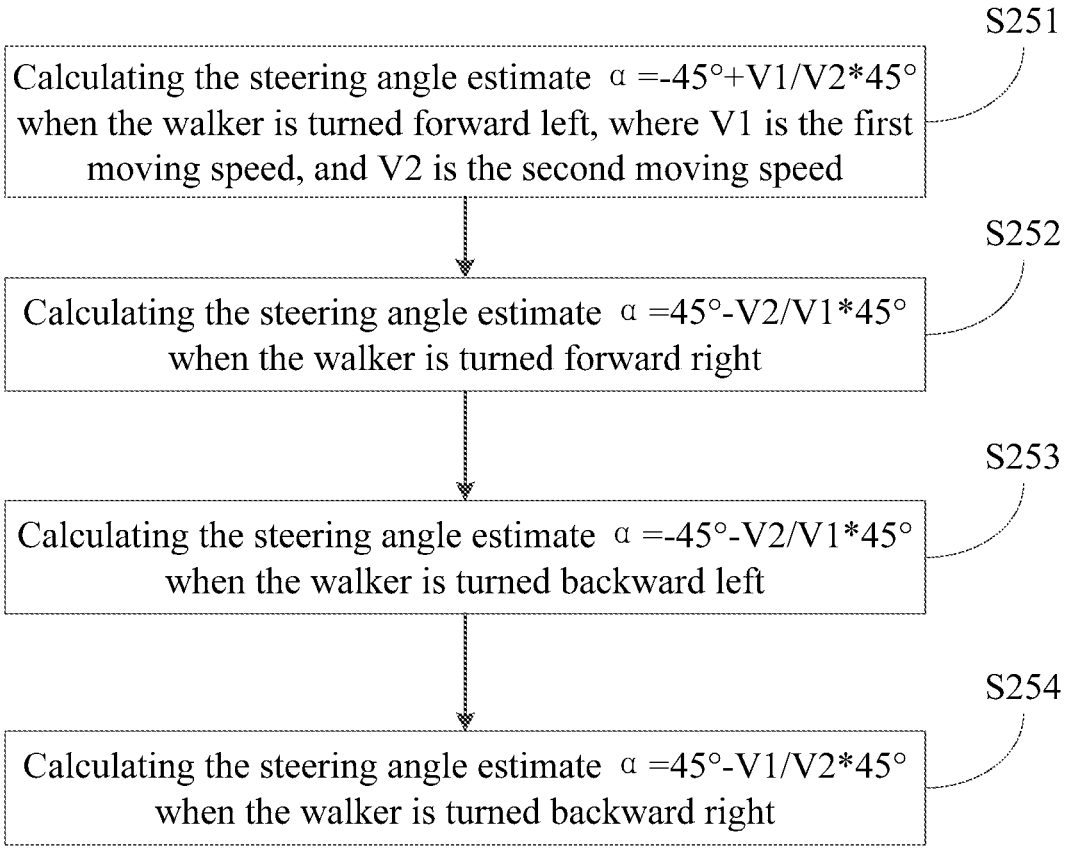
FIG. 4 is a schematic flowchart illustrating some steps of the method of steering assist control for a walker according to another embodiment of the present disclosure.

Referring to FIG. 4, in the embodiment, when the radial directions of the left and right wheels are parallel to the front and back directions, the steering angles of the left and right wheels are defined as 0; when the left and right wheels turn to the left until the axial direction is perpendicular to the front and back directions, the steering angle of the left wheel and the right wheel is defined as −90°; when the left wheel and the right wheel turn to the right until the axial direction is perpendicular to the front and back directions, the steering angle of the left wheel and the right wheel is defined as 90°. The step of calculating the steering angle estimate may specifically include:

S251, calculating the steering angle estimate $\alpha=-45°\pm V1/V2*45°$ when the walker is turned forward left, where V1 is the first moving speed, and V2 is the second moving speed;

S252, calculating the steering angle estimate $\alpha=45°-V2/V1*45°$ when the walker is turned forward right;

S253, calculating the steering angle estimate $\alpha=-45°-V2/V1*45°$ when the walker is turned backward left;

S254, calculating the steering angle estimate $\alpha=45°-V1/V2*45°$ when the walker is turned backward right.

Referring back to FIG. 2, in S260, acquiring steering assist compensations according to the steering angle estimate, and performing an assist compensation on the left wheel and/or the right wheel according to the steering assist compensations.

Figure 5:
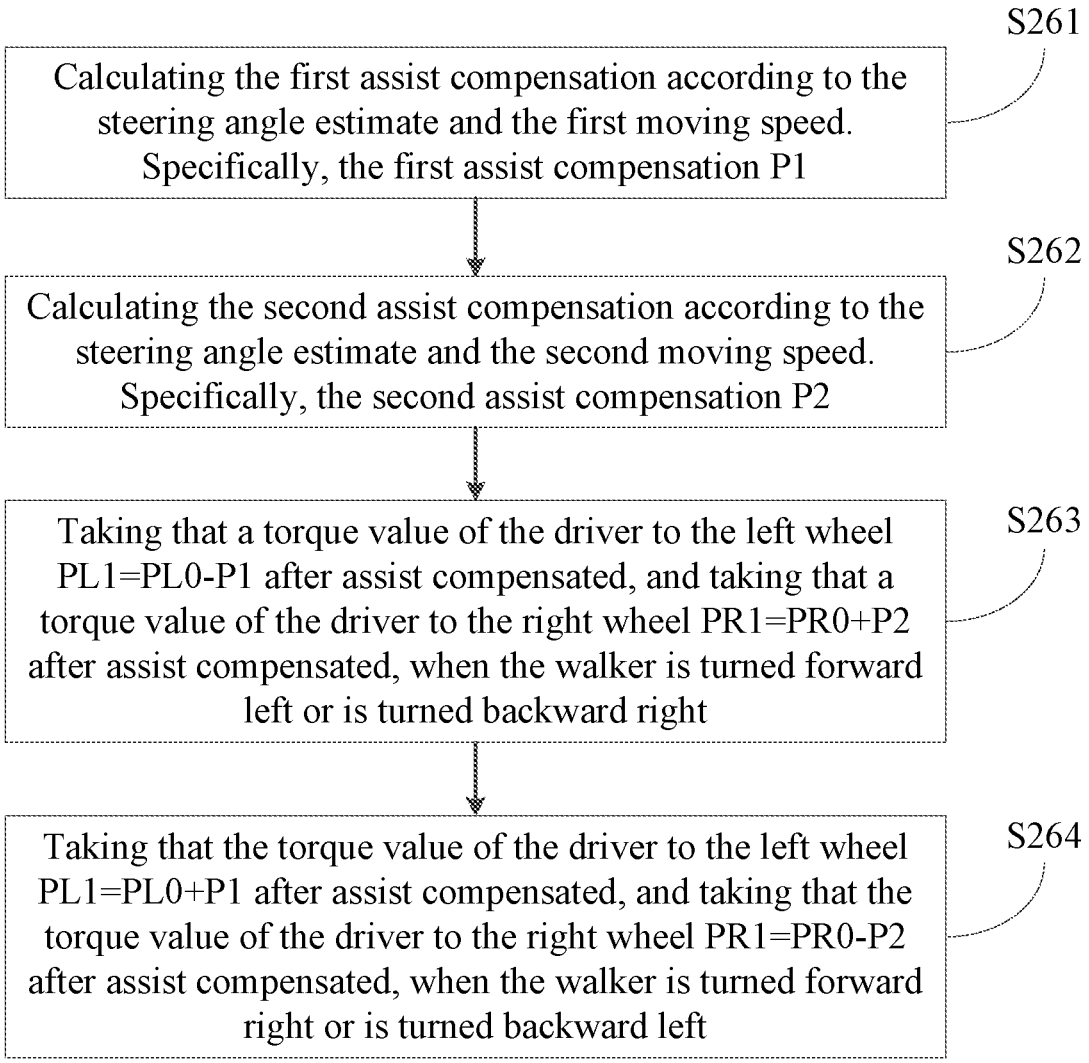
FIG. 5 is a schematic flowchart illustrating some steps of the method of steering assist control for a walker according to another embodiment of the present disclosure.

Referring to FIG. 5, in the embodiment, the assist compensations may include a first assist compensation and/or a second assist compensation, and the step of calculating the steering assist compensations according to the steering angle estimate may specifically include:

S261, calculatingthe first assist compensation according to the steering angle estimate and the first moving speed. Specifically, the first assist compensation $P1=K*(|\alpha|*V1/M1)*(|\alpha|/90+1))$, where K is a proportional parameter in different gears, is an absolute of the steering angle estimate, V1 is the first moving speed, and M1 is an adjustment ratio of the left wheel speed. And/or S262, calculating the second assist compensation according to the steering angle estimate and the second moving speed. Specifically, the second assist compensation $P2=K*(|\alpha|*V2/M2)*(|\alpha|/90+1)$, where V2 is the second moving speed, and M2 is an adjustment ratio of the right wheel speed.

In the embodiment, the speed gear of the walker can be manually or automatically set according to the user's needs. Each gear may correspond to a value of K, and K can be 0.1 to 1, such as 0.1, 0.6 or 1. In other embodiments, K can also be a fixed value, such as 0.5, 0.8, or 1.

In the embodiment, the adjustment ratio of the left wheel speed can be set manually or automatically, and M1 can be 1 to 100, such as 1, 55, or 100.

In the embodiment, the adjustment ratio of the right wheel speed can be set manually or automatically, and M2 can be 1 to 100, such as 1, 55, or 100.

In the embodiment, the walker may further include a driver configured for driving the left wheel and/or the right wheel. If the walker is turned forward left or backward right, the first assist compensation is inversely proportional to the first moving speed and the steering angle estimate, and the second assist compensation is proportional to the second moving speed and the steering angle estimate. That is, it is necessary to reduce the torque of the driver to the left wheel and increase the torque of the driver to the right wheel to help steering of the walker, making the steering more labor-saving. In the same way, if the walker is turned forward right or tuned backward left, the first assist compensation is proportional to the first moving speed and the steering angle estimate, and the second assist compensation is inversely proportional to the second moving speed and the steering angle estimate. That is, it is necessary to increase the torque of the driver to the left wheel and reduce the torque of the driver to the right wheel to help the walker turn and make the steering more effortless.

In the embodiment, the driver may include at least two driving membersrespectively configured for driving the left wheel and the right wheel. In other embodiments, the driver may also include only one driving member for driving the left and right wheels.

Referring to FIG. 5, in the embodiment, the step of performing an assist compensation on the left wheel and/or the right wheel according to the steering assist compensations may specifically include:

S263, taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

S264, taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

In the embodiment, the left wheel and/or the right wheel of the walker can be assist compensated when the walker is turned, such that the user can save more effort when pushing the walker to turn, such that the user with less strength can use the walker. It is more convenient to use when driving, reduces the influence of steering on the traveling speed of the walker. The normal travel of the walker can be ensured, sudden stop caused by the increase of steering resistance can be avoided, and safety can be improved.

Figure 6:
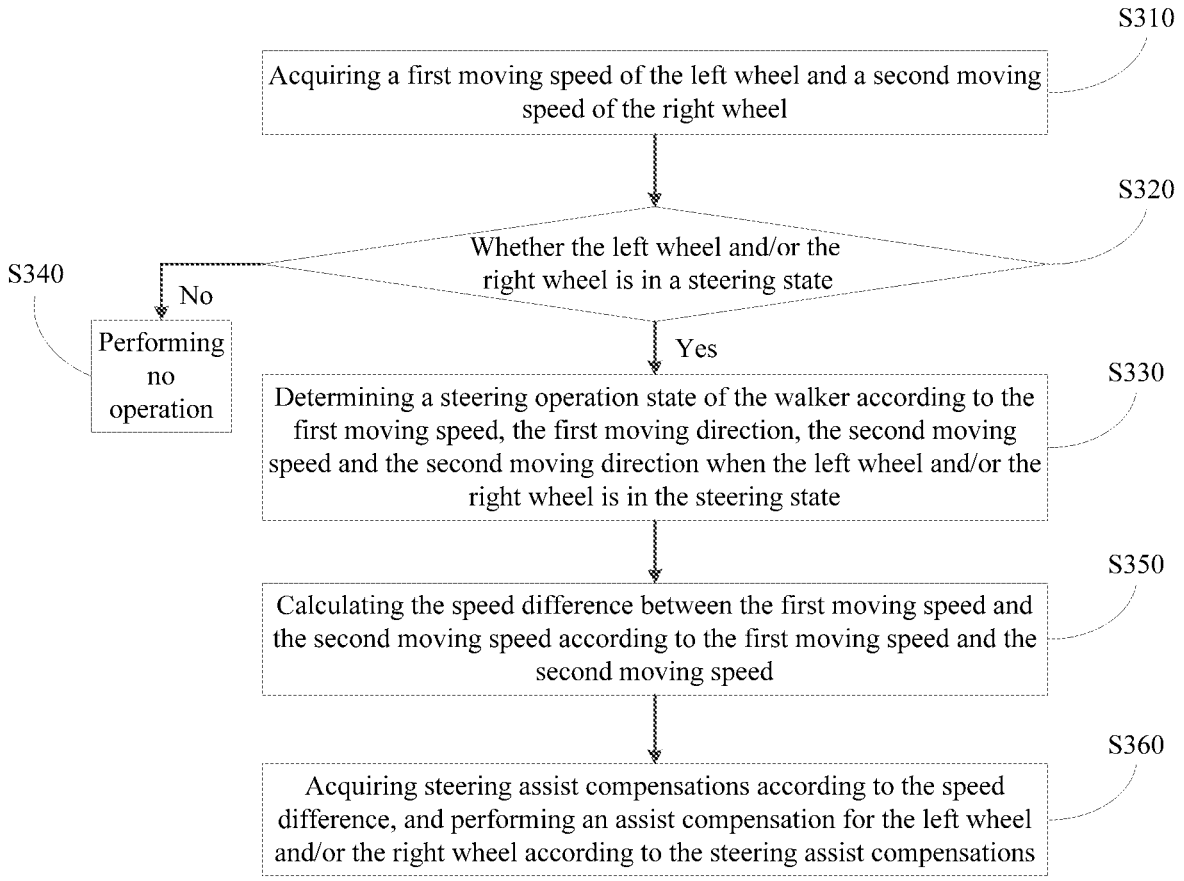
FIG. 6 is a schematic flowchart illustrating the method of steering assist control for a walker according to another embodiment of the present disclosure.

Referring to FIG. 6, the walker of the present disclosure may include a main frame, a left wheel and a right wheel respectively provided at the bottom of the main frame. Another embodiment of the method of steering assist control for the walker may include:

S310, acquiring a first moving speed of the left wheel and a second moving speed of the right wheel;

S320, determining whether the left wheel and/or the right wheel is in a steering state;

S330, determining a steering operation state of the walker according to the first moving speed, the first moving direction, the second moving speed and the second moving direction when the left wheel and/or the right wheel is in the steering state, S340, performing no operation when the left wheel and/or the right wheel are not in the steering state.

In the embodiment, for the specific steps of S310 to S340, reference may be made to S210 to S240 in the embodiment of the steps of steering assist control for a walker, which will not be repeated here.

S350, calculating the speed difference between the first moving speed and the second moving speed according to the first moving speed and the second moving speed;

S360, acquiring steering assist compensations according to the speed difference, and performing an assist compensation for the left wheel and/or the right wheel according to the steering assist compensations.

Figure 7:
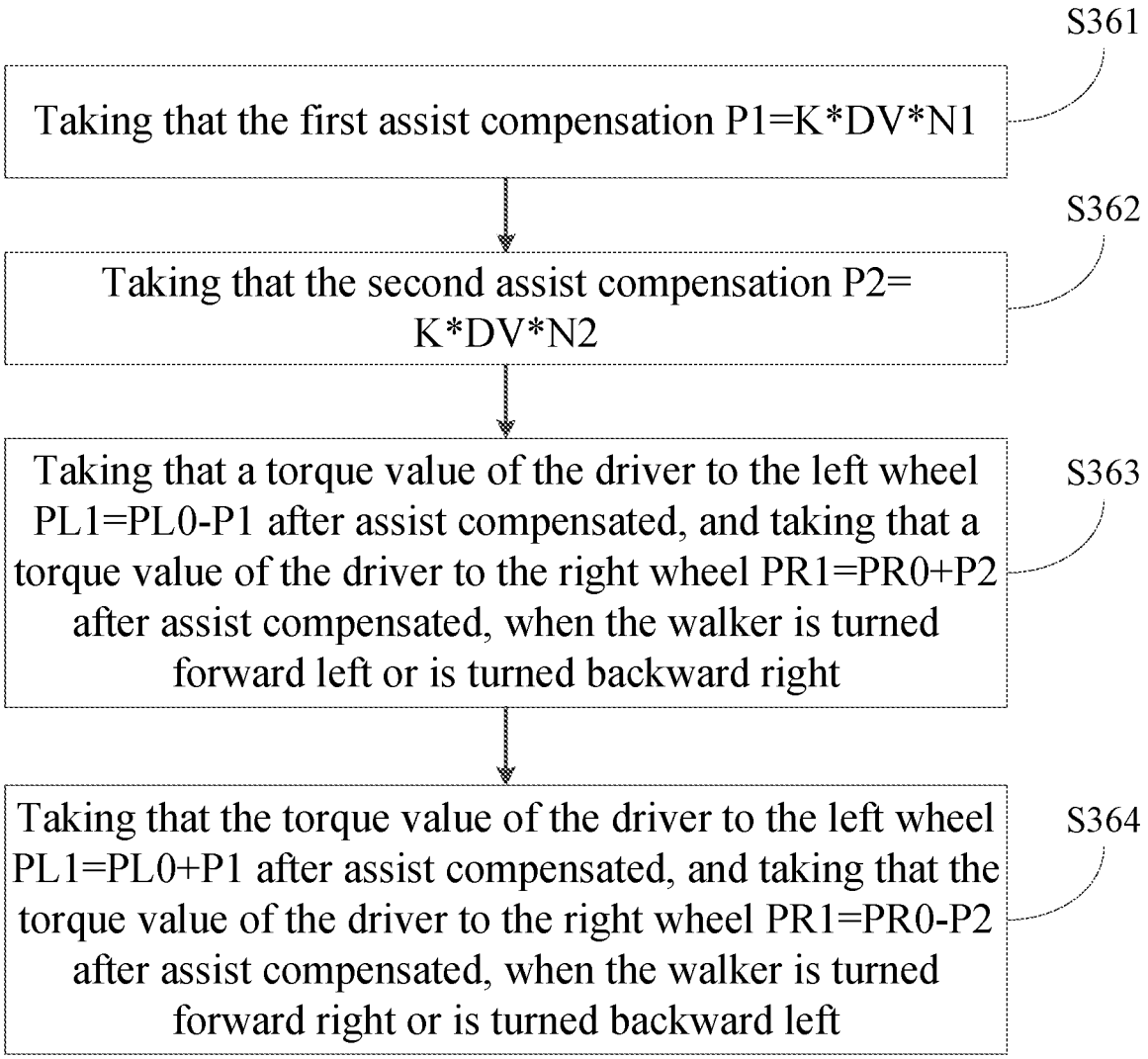
FIG. 7 is a schematic flowchart illustrating some steps of the method of steering assist control for a walker according to another embodiment of the present disclosure.

Referring to FIG. 7, in the embodiment, the walker may further include a driver configured for driving the left wheel and/or the right wheel, and the assist compensations may include a first assist compensation and/or a second assist compensation. The step of acquiring steering assist compensations according to the speed difference comprises according to the speed difference; and performing an assist compensation for the left wheel and/or the right wheel according to the steering assist compensations may specifically include:

S361, taking that the first assist compensation P1=K*DV*N1, where K is the proportional parameter in different gears, DV is the speed difference between the first moving speed V1 and the second moving speed V2, N1 is a differential compensation ratio of the left wheel;

S362, taking that the second assist compensation P2=K*DV*N2, where N2 is a differential compensation ratio of the right wheel.

In the embodiment, the speed gear of the walker can be manually or automatically set according to the user's needs. Each gear may correspond to a value of K, and K can be 0.1 to 1, such as 0.1, 0.6 or 1. In other embodiments, K can also be a fixed value, such as 0.5, 0.8, or 1.

In the embodiment, the speed adjustment ratio of the left wheel can be set manually or automatically, and N1 can be 0 to 1, such as 0, 0.5, or 1.

In the embodiment, the speed adjustment ratio of the right wheel can be set manually or automatically, and N2 can be 0 to 1, such as 0, 0.5, or 1.

In the embodiment, if the walker is turned forward left or is turned backward right, the first assist compensation may be inversely proportional to the first moving speed and the speed difference, and the second assist compensation may be proportional to the second moving speed and the speed difference. That is, it is necessary to reduce the torque of the driver to the left wheel and increase the torque of the driver to the right wheel to help the walker turn and make the steering more labor-saving. In the same way, if the walker is turned forward right or is tuned backward left, the first assist compensation is proportional to the first moving speed and the speed difference, and the second assist compensation is inversely proportional to the second moving speed and the speed difference. That is, it is necessary to increase the torque of the driver to the left wheel and reduce the torque of the driver to the right wheel to help the walker turn and make the steering more effortless.

S363, taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

S364, taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

In the embodiment, the left wheel and/or the right wheel of the walker can be assist compensated when the walker is turned, such that the user can save more effort when pushing the walker to turn, such that the user with less strength can use the walker. It is more convenient to use when driving, reduces the influence of steering on the traveling speed of the walker. The normal travel of the walker can be ensured, sudden stop caused by the increase of steering resistance can be avoided, and safety can be improved.

Figure 8:
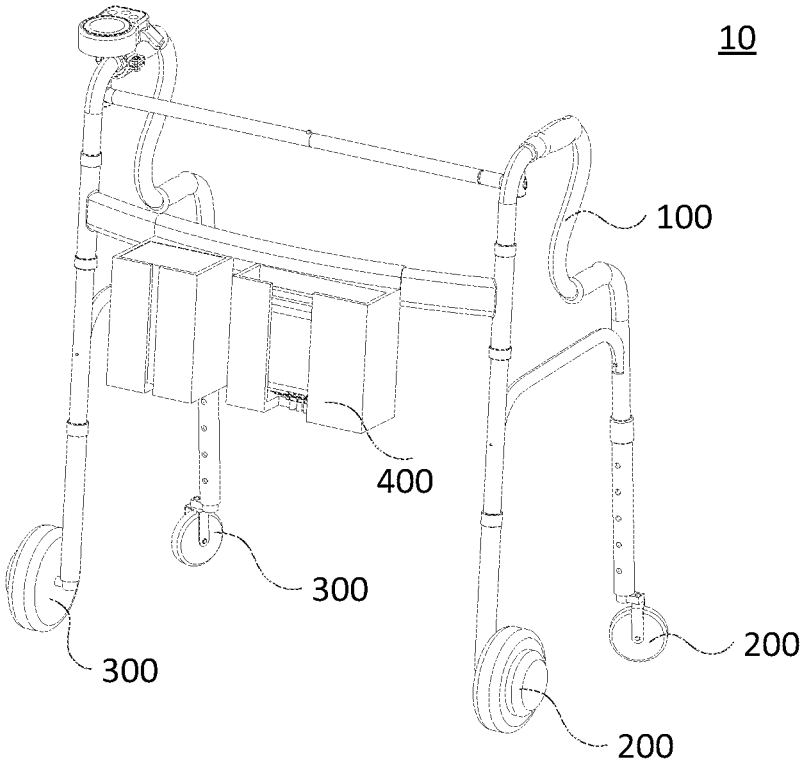
FIG. 8 is a schematic structural diagram illustrating a walker according to an embodiment of the present disclosure.
Figure 9:
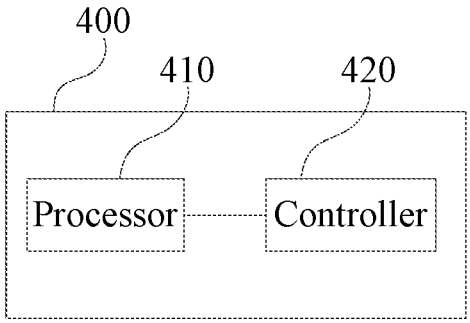
FIG. 9 is a schematic structural diagram illustrating a device of steering assist control for the walker according to an embodiment of the present disclosure.

Referring to FIGS. 8 and 9, the walker 10 of the present disclosure may include a main frame 100, a left wheel 200 and a right wheel 300 respectively provided at the bottom of the main frame 100. The embodiment of the device 400 of assist steering control of the walker 10 may include a processor 410 and a controller 420. The processor 410 may be configured for acquiring a first moving speed of the left wheel and a second moving speed of the right wheel, determining whether the left wheel and/or the right wheel is in a steering state, calculating a steering angle estimate or a speed difference between the first moving speed and the second moving speed according to the first moving speed and the second moving speed when the left wheel and/or the right wheel is in the steering state, and acquiring steering assist compensations according to the steering angle estimate or the speed difference. The controller may be configured for performing an assist compensation on the left wheel 200 and/or the right wheel 300 according to the steering assist compensations.

In the embodiment, the left wheel 200 and/or the right wheel 300 of the walker 10 can be assist compensated when the walker 10 is turned, such that the user can save more effort when pushing the walker 10 to turn, such that the user with less strength can use the walker 10. It is more convenient to use when driving, reduces the influence of steering on the traveling speed of the walker 10. The normal travel of the walker 10 can be ensured, sudden stop caused by the increase of steering resistance can be avoided, and safety can be improved.

Figure 10:
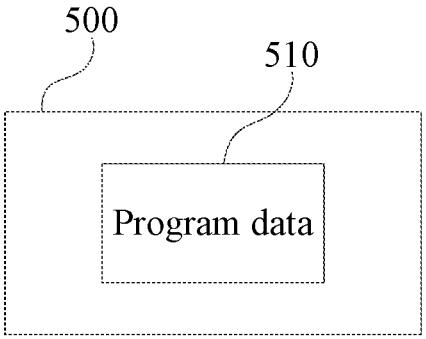
FIG. 10 is a schematic structural diagram of the memory according to the present disclosure.

Referring to FIG. 10, the memory 500 of the present disclosure can store program data 510, and the program data 510 can be executed to implement the method of steering assist control as in the above embodiment of the method of steering assist control for the walker.

In the embodiment, the memory 500 may be a portable storage medium, such as a U disk, an optical disk, etc., or a terminal, a server, and the like.

In the embodiment, the left wheel and/or the right wheel of the walker can be assist compensated when the walker is turned, such that the user can save more effort when pushing the walker to turn, such that the user with less strength can use the walker. It is more convenient to use when driving, reduces the influence of steering on the traveling speed of the walker. The normal travel of the walker can be ensured, sudden stop caused by the increase of steering resistance can be avoided, and safety can be improved.

The above description is merely some embodiments of the present disclosure, and is not intended to limit the scope of the present disclosure. Any equivalent structure or equivalent process transformation made by using the contents of the description and drawings of the present disclosure, or directly or indirectly applied to other related technical field are similarly included in the scope of patent protection of the present disclosure.

What is claimed is:

1. A method of steering assist control for a walker, the walker comprising a main frame and a left wheel and a right wheel respectively provided at the bottom of the main frame, wherein the method of steering assist control comprises:

acquiring a first moving speed of the left wheel and a second moving speed of the right wheel;

determining whether the left wheel and/or the right wheel is in a steering state;

calculating a steering angle estimate or a speed difference between the first moving speed and the second moving speed according to the first moving speed and the second moving speed when the left wheel and/or the right wheel is in the steering state; and acquiring steering assist compensations according to the steering angle estimate or the speed difference, and performing an assist compensation on the left wheel and/or the right wheel according to the steering assist compensations; the assist compensations comprise a first assist compensation and/or a second assist compensation, wherein the step of acquiring steering assist compensations according to the speed difference comprises: taking that the first assist compensation P1=K*DV*N1, and that the second assist compensation P2=K*DV*N2, where K is the proportional parameter in different gears, DV is the speed difference, N1 is a differential compensation ratio of the left wheel, and N2 is a differential compensation ratio of the right wheel.

2. The method of steering assist control according to claim 1, wherein the step of determining whether the left wheel and/or the right wheel is in a steering state comprises:

acquiring a first moving direction of the left wheel and a second moving direction of the right wheel;

determining whether both the first moving direction and the second moving direction are forward or backward, and whether the difference between the first moving speed and the second moving speed is less than a threshold;

determining that the left wheel and/or the right wheel is in a straight state when both the first moving direction and the second moving direction are forward or backward, and the difference between the first moving speed and the second moving speed is less than the threshold;

determining that the left wheel and/or the right wheel is in the steering state when otherwise.

3. The method of steering assist control according to claim 1, wherein before acquiring the first moving speed of the left wheel and the second moving speed of the right wheel, the method further comprises:

determining whether steering assist compensation is required for the left wheel and/or the right wheel;

acquiring the first moving speed of the left wheel and the second moving speed of the right wheel when steering assist compensation is required for the left wheel and/or the right wheel;

performing no operation when otherwise.

4. The method of steering assist control according to claim 3, wherein the step of determining whether steering assist compensation is required for the left wheel and/or the right wheel comprises:

determining whether a load of the main frame exceeds a weight threshold;

performing the steering assist compensation on the left wheel and/or the right wheel when the load of the main frame exceeds the weight threshold;

performing no operation when otherwise.

5. The method of steering assist control according to claim 3, wherein the step of determining whether steering assist compensation is required for the left wheel and/or the right wheel comprises:

determining whether a friction between the left and/or right wheels and a road surface exceeds a resistance threshold;

performing the steering assist compensation on the left wheel and/or the right wheel when the friction between the left and/or right wheels and the road surface exceeds the resistance threshold;

performing no operation when otherwise.

6. The method of steering assist control according to claim 2, wherein after determining that the left wheel and/or the right wheel is in a steering state, the method further comprises:

determining a steering operation state of the walker according to the first moving speed, the first moving direction, the second moving speed and the second moving direction.

7. The method of steering assist control according to claim 6, wherein the step of determining a steering operation state of the walker according to the first moving speed, the first moving direction, the second moving speed and the second moving direction comprises:

determining that the walker is turned forward left when the second moving direction is forward, and an absolute of the second moving speed is greater than or equal to an absolute of the first moving speed;

determining that the walker is turned forward right when the first moving direction is forward, and the absolute of the first moving speed is greater than or equal to the absolute of the second moving speed;

determining that the walker is turned backward left when the first moving direction is backward, and the absolute of the first moving speed is greater than the absolute of the second moving speed;

determining that the walker is turned backward right when the second moving direction is backward, and the absolute of the second moving speed is greater than the absolute of the first moving speed.

8. The method of steering assist control according to claim 7, wherein the step of calculating the steering angle estimate comprises:

calculating the steering angle estimate $\alpha=-45°\pm V1/V2*45°$ when the walker is turned forward left, where V1 is the first moving speed, and V2 is the second moving speed;

calculating the steering angle estimate $\alpha=45°-V2/V1*45°$ when the walker is turned forward right;

calculating the steering angle estimate $\alpha=-45°-V2/V1*45°$ when the walker is turned backward left;

calculating the steering angle estimate $\alpha=45°-V1/V2*45°$ when the walker is turned backward right.

9. The method of steering assist control according to claim 8, wherein the assist compensations comprise a first assist compensation and/or a second assist compensation, and the step of calculating the steering assist compensations according to the steering angle estimate comprises:

calculating the first assist compensation according to the steering angle estimate and the first moving speed; and/or calculating the second assist compensation according to the steering angle estimate and the second moving speed.

10. The method of steering assist control according to claim 8, wherein the assist compensations comprise a first assist compensation and/or a second assist compensation;

if the walker is turned forward left or tuned backward right, the first assist compensation is inversely proportional to the first moving speed and the steering angle estimate, and the second assist compensation is proportional to the second moving speed and the steering angle estimate;

if the walker is turned forward right or tuned backward left, the first assist compensation is proportional to the first moving speed and the steering angle estimate, and the second assist compensation is inversely proportional to the second moving speed and the steering angle estimate.

11. The method of steering assist control according to claim 8, wherein the assist compensations comprise a first assist compensation and/or a second assist compensation;

the first assist compensation $P1=K*(|\alpha|*V1/M1)*(|\alpha|/90+1))$, where K is a proportional parameter in different gears, is an absolute of the steering angle estimate, V1 is the first moving speed, and M1 is an adjustment ratio of the left wheel speed;

the second assist compensation $P2=K*(|\alpha|*V2/M2)*(|\alpha|/90+1)$, where V2 is the second moving speed, and M2 is an adjustment ratio of the right wheel speed.

12. The method of steering assist control according to claim 11, wherein the walker further comprises a driver configured for driving the left wheel and/or the right wheel, the step of performing an assist compensation on the left wheel and/or the right wheel according to the steering assist compensations comprises:

taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

13. The method of steering assist control according to claim 11, wherein K is 0.1 to 1, M1 is 1 to 100, and M2 is 1 to 100.

14. The method of steering assist control according to claim 7, wherein the assist compensations comprise a first assist compensation and/or a second assist compensation;

if the walker is turned forward left or is turned backward right, the first assist compensation is inversely proportional to the first moving speed and the speed difference, and the second assist compensation is proportional to the second moving speed and the speed difference;

if the walker is turned forward right or is turned backward left, the first assist compensation is proportional to the first moving speed and the speed difference, and the second assist compensation is inversely proportional to the second moving speed and the speed difference.

15. The method of steering assist control according to claim 1, wherein the walker further comprises a driver configured for driving the left wheel and/or the right wheel, and the step of performing the steering assist compensation on the left wheel and/or the right wheel according to the steering assist compensations comprises:

taking that a torque value of the driver to the left wheel PL1=PL0-P1 after assist compensated, and taking that a torque value of the driver to the right wheel PR1=PR0+P2 after assist compensated, when the walker is turned forward left or is turned backward right, where PL0 is the torque value of the driver to the left wheel before assist compensated, and PR0 is the torque value of the driver to the right wheel before assist compensated;

taking that the torque value of the driver to the left wheel PL1=PL0+P1 after assist compensated, and taking that the torque value of the driver to the right wheel PR1=PR0-P2 after assist compensated, when the walker is turned forward right or is turned backward left.

16. The method of steering assist control according to claim 1, wherein K is 0.1 to 1, N1 is 0 to 1, and N2 is 0 to 1.

17. The method of steering assist control according to claim 2, wherein the threshold value is less than or equal to 5 rad/min.

18. A memory storing program data, wherein the program data is capable to be executed to implement the method of steering assist control according to claim 1.

19. A device of steering assist control for a walker, the walker comprising a main frame and a left wheel and a right wheel respectively provided at a bottom of the main frame, wherein the device of steering assist control comprises:

a processor configured for acquiring a first moving speed of the left wheel and a second moving speed of the right wheel, determining whether the left wheel and/or the right wheel is in a steering state, calculating a steering angle estimate or a speed difference between the first moving speed and the second moving speed according to the first moving speed and the second moving speed when the left wheel and/or the right wheel is in the steering state, and acquiring steering assist compensations according to the steering angle estimate or the speed difference;

the processor is further configured to calculate a first assist compensation and/or a second assist compensation: taking that the first assist compensation P1=K*DV*N1, and that the second assist compensation P2=K*DV*N2, where K is the proportional parameter in different gears, DV is the speed difference, N1 is a differential compensation ratio of the left wheel, and N2 is a differential compensation ratio of the right wheel; and a controller configured for performing an assist compensation on the left wheel and/or the right wheel according to the steering assist compensations.

* * * * *